US006264052B1

(12) United States Patent
Schmitz

(10) Patent No.: US 6,264,052 B1
(45) Date of Patent: Jul. 24, 2001

(54) SCREW-TYPE CAP INCLUDING AN EXPANDABLE TAMPERPROOF STRIP

(75) Inventor: Alexander Schmitz, Niedernhausen (DE)

(73) Assignee: CCT Creative Closure Technology GmbH, Niedernhausen (DE)

( * ) Notice: Subject to any disclaimer, the term of this patent is extended or adjusted under 35 U.S.C. 154(b) by 0 days.

(21) Appl. No.: 09/341,451

(22) PCT Filed: Jan. 7, 1998

(86) PCT No.: PCT/EP98/00051

§ 371 Date: Aug. 31, 1999

§ 102(e) Date: Aug. 31, 1999

(87) PCT Pub. No.: WO98/30462

PCT Pub. Date: Jul. 16, 1998

(30) Foreign Application Priority Data

Jan. 9, 1997 (DE) ..... 197 00 308

(51) Int. Cl.[7] ..... B65D 41/34
(52) U.S. Cl. ..... 215/252
(58) Field of Search ..... 215/252

(56) References Cited

U.S. PATENT DOCUMENTS 4,278,180 * 7/1981 Willis ..... 215/252
4,305,516 * 12/1981 Perne et al. ..... 215/252
4,394,918 * 7/1983 Grussen ..... 215/252 X
4,480,761 * 11/1984 Aichinger ..... 215/252
4,664,279 * 5/1987 Obrist et al. ..... 215/252
5,056,675 * 10/1991 Julian ..... 215/252
5,246,125 9/1993 Julian .
5,755,346 * 5/1998 Ekkert ..... 215/252

FOREIGN PATENT DOCUMENTS

4206123A1 11/1992 (DE) .
2457813 12/1980 (FR) .
2096114 * 10/1982 (GB) ..... 215/252
2255553 * 7/1991 (GB) .

* cited by examiner

*Primary Examiner*—Allan N. Shoap
*Assistant Examiner*—Robin A. Hylton
(74) *Attorney, Agent, or Firm*—Townsend and Townsend and Crew LLP

(57) ABSTRACT

A screw-type bottle cap having a body with an internal thread and a tamperproof strip which has at least one expansion structure that includes at least one point at which it is fixed to the cap body. In this way, a screw-type cap is produced which has a reliable tamperproof function wherein the tamperproof strip remains attached to the cap body when the cap is unscrewed, without the free ends of the strip protruding from the cap body.

5 Claims, 2 Drawing Sheets

SCREW-TYPE CAP INCLUDING AN EXPANDABLE TAMPERPROOF STRIP

BACKGROUND OF THE INVENTION

1. Field of the Invention

The present invention relates to a plastic screw-type bottle cap comprising a cap body with an internal thread and a tamperproof strip. The latter has flanges disposed on the inside thereof, is non-breakable and is connected by webs to the cap body. As the cap body is unthreaded from the bottle the tension or strain in the webs increases causing the latter to break. The tamperproof strip includes an expansion means with at least one permanent connection disposed in the area between the tamperproof strip and the cap body.

2. Description of the Prior Art

Screw-type caps of this type are widespread and are used in particular on glass or plastic beverage containers. Such bottles are produced in a variety of standard sizes and are circulated in large numbers, either in returnable or non-returnable form. In particular it is the standardized bottle neck and accompanying thread in bottles of this type that make it possible, despite differences in bottle sizes, to employ a uniform screw-cap. Though this offers many advantages, there is one distinct disadvantage, in that with the continously large number of bottles in circulation, it is virtually impossible to alter the geometry of the bottle neck. As a result, screw-caps, as so-called disposable articles, must be adapted to the geometry of a given bottle neck or thread configuration. Within the bottle-neck-screw-cap system, therefore, modifications are economically feasible only with regard to the screw-cap.

Known screw-type plastic bottle caps are generally comprised of a cap body with an internal thread and a tamperproof strip. Conventionally, the tamperproof strip is made so that it detaches at least partially from the cap body when the cap is unthreaded. This is intended as an indication to the consumer that the bottle was either previously opened, or has not yet been tampered with.

Normally, the tamperproof strip is in the form of a ring connected to the cap body by thin webs. In addition, flange-like elements or lamellae are provided on the inside of the tamperproof strip which form a so-called stop ring when the cap is screwed on, and which engage the stop ring on the bottle from behind. Such a stop ring is usually formed on the neck of the bottle immediately below the external thread near the body of the bottle and, in standardized form, has an equivalent or slightly larger diameter than the external thread disposed immediately above it. Due to the slightly conic inclination of the stop ring where it meets the body of the bottle, the tamperproof strip expands circumferentially outward somewhat as a result of inherent elasticity of the plastic material used. The flanges or lamellae formed on the inside of the strip are thus able to slip past the stop ring and lock in place once the cap is completely threaded on, thereby engaging the stop ring from behind.

As the bottle is sealed, the flanges or lamellae secure the tamperproof strip to the stop ring, while webs, designed as predetermined breaking points, break as a result of the tension placed on the plastic material. The fractured connection between the tamperproof strip and the cap body is a direct indication that the bottle was previously opened.

Tamperproof strips are known in basically two different embodiments. In the first tamperproof strip embodiment, the strip detaches completely from the cap body as the latter is unthreaded, and it remains behind as a ring on the neck of the bottle. This embodiment is disadvantageous, however, particularly with regard to waste disposal. Because the tamperproof strip remains on non-returnable bottles, which are melted down after one use, the resultant melt becomes contaminated. In the case of returnable bottles on the other hand, the old tamperproof strip must be removed prior to refilling and resealing before the new screw-cap can be attached.

Environmental factors as well do not favor this embodiment, since it is entirely possible that the tamperproof strip stuck initially to the neck of the bottle may become detached and lost in the environment as undesirable litter.

Esthetic considerations, an ever stronger selling point, are a further reason against the tamperproof strip remaining on the neck of the bottle, as this is considered a nuisance by many consumers.

The second known tamperproof strip embodiment ruptures when the screw-cap is removed, but otherwise remains attached to the cap body. Here, the protruding ends of the tamperproof strip are considered especially disadvantageous because they are a nuisance to the consumer while threading and unthreading the cap, and they may result in bodily injury. Esthetic considerations also weigh against the use of this tamperproof strip embodiment, as the protruding ends are found to be a nuisance by the consumer.

The closest cited prior art is U.S. Pat. No. 5,246,125. The screw-type cap disclosed therein possesses the features set forth above. When threading and unthreading this screw-cap from the bottle, the tamperproof strip expands in an axial direction due to an expansion means and is held in place at a connection point located near said expansion means. This action presents serious problems, however, when the mold is released during the manufacturing process, because even as the mold is released a tension is placed on the webs between the tamperproof strip and the cap body, and thus they tend to break during manufacturing.

Another screw-type plastic cap is known from German patent publication DE-A-42 6 123, in which a tamperproof strip is also connected by webs to the cap body. The tamperproof strip of this screw-cap also has an expansion means, but it too only expands in an axial direction.

SUMMARY OF THE INVENTION

In light of this background art, therefore, the object of the present invention is to provide a screw-type plastic bottle cap comprised of a cap body with an internal thread and a tamperproof strip, the latter of which exhibits a more reliable tamperproof function and which remains attached to the cap body without free ends protruding therefrom.

The object is achieved in that the expansion means, as the cap body is threaded onto the bottle, uniformly expands the tamperproof strip along its entire width in a radial direction in such a way that the flanges slip past the stop ring.

A screw-type cap embodiment according to the present invention not only results in a reliable tamperproof function, but also ensures that the tamperproof strip remains attached to the cap body. As the screw-cap is threaded onto the neck of the bottle, the tamperproof strip expands due to the conical shape of the stop ring. Together with its flanges or lamellae, the tamperproof strip slips past the stop ring, while the webs between the tamperproof strip and the cap body are placed under pressure as the latter is threaded, and said webs are therefore unable to fracture.

Conversely, when opening the bottle by unthreading the screw-cap, the flanges or lamellae secure the tamperproof strip initially to the stop ring, such that now the webs between the tamperproof strip and the cap body are placed in tension. By further rotating the cap body, the tension in the webs is further increased to the point that the webs finally fracture. The tamperproof strip, however, remains attached via the permanent connection to the cap body, while further rotating the cap body causes the tension in the tamperproof strip to increase, and the expansion means on the tamperproof strip to stretch to a point where it is able to slip past the stop ring. At this point the screw-cap may be fully unthreaded, in which case the tamperproof strip remains attached via the permanent connection to the cap body, and the fractured webs between the tamperproof strip and the cap body indicate that the given screw-cap was activated. Thus, the consumer immediately recognizes that the bottle in question has already been opened. Moreover, that the tamperproof strip remains attached to the cap body, helps to circumvent problems of disposal or the environment. Finally, that the tamperproof strip does not fracture during threading, also prevents protruding strip ends from annoying and possible injuring the consumer, and which results in an overall more esthetically pleasing screw-type bottle cap.

In accordance with a preferred embodiment of the present invention, the expansion means has at least two recesses directed substantially transversely in the tamperproof strip and which are open ended at opposite edges, respectively of the strip. This allows the tamperproof strip to expanded in a particularly simple way by stretching it in an accordion-like manner. Preferrably, the tamperproof strip has two expansion means disposed on opposite sides thereof. This allows for uniform expansion of the tamperproof strip in a simple manner, enabling the strip to slip effortlessly and without snagging past the stop ring as the screw-cap is being threaded.

In a further advantageous modification of the present invention the expansion means has two recesses arranged on one side of the permanent connection. This allows for directed expansion of the tamperproof strip from one side of the permanent connection.

In another preferred embodiment of the present invention, the expansion means has two recesses arranged on opposite sides of the permanent connection which allows for uniform expansion of the tamperproof strip from both sides of the permanent connection.

In yet another preferred modification of the present invention, a tamperproof strip is provided without vertical lines of weakening. In another words, the former has no predetermined breaking points, as is the case for instance in screw-caps according to German patent publication DE-A-42 06 123 and EP-A-0 460 557. In the present embodiment the tamperproof strip is divided into two functional halves. The first half serves essentially to allow expansion of the tamperproof strip during the manufacturing process when threaded onto the bottle. The expansion step is ensured by undercutting the flanges and by adding an additional link to the cap body. The first half is capable of extreme expansion, freely and independently of the second half. The second half ensures essentially that the tamperproof function is reliable. In the manufacturing process expansion is ensured by the expansion means in connection with a horizontal tie. The purpose of dividing the tamperproof strip into two functional halves is seen in that the second half is required to expand less than the first half. This serves to further enhance the reliability of the tamperproof function and to facilitate resealing of the bottle by the consumer.

BRIEF DESCRIPTION OF THE DRAWINGS

The invention is described in greater detail below with reference to preferred embodiments, in which.

DETAILED DESCRIPTION OF THE PREFERRED EXEMPLARY EMBODIMENT

Figure 1:
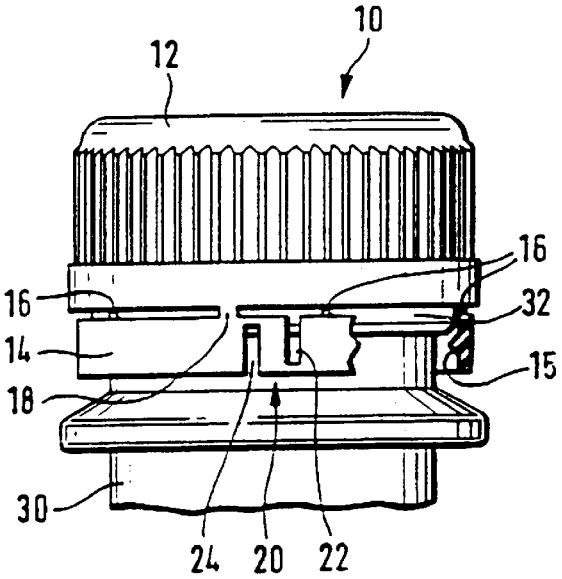
FIG. 1 is a side view of a first embodiment of the screw-type cap according to the present invention when threaded, and with a partial sectional view through the tamperproof strip.

FIG. 1 is a side view of a first embodiment of the screw-type cap 10 according to the present invention. Screw-type cap 10 is comprised essentially of a cap body 12 and the tamperproof strip 14, and is threaded onto the neck 30 of a bottle. Tamperproof strip 14 is connected to the cap body 12 by webs 16 and permanent connection 18. Further, the tamperproof strip 14 is provided with internal flanges 15 and an expansion means 20. Expansion means 20 has two recesses 22 and 24, each in the form of a slot. Recess 22 is open at the end proximate the cap body 12, while recess 24 is open at the end proximate the bottle; for the sake of simplicity, only the neck 30 of the bottle is shown here.

Tamperproof strip 14, shown here in the threaded position, does not expand and flanges 15 engage stop ring 32 on bottle neck 30 from behind.

Figure 2:
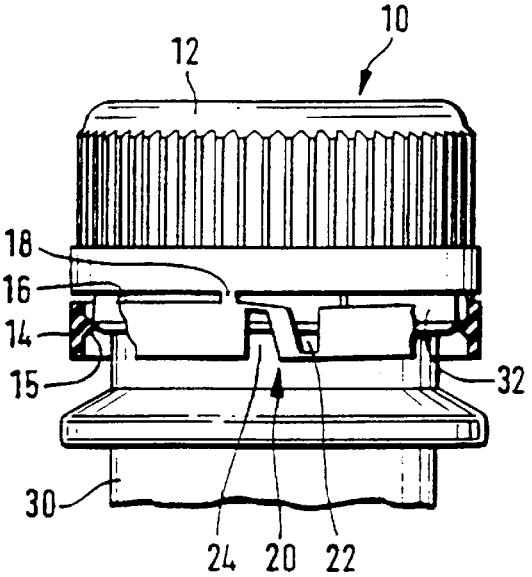
FIG. 2 is a side view of said first embodiment when threaded with partial sectional views through the tamperproof strip.

FIG. 2 shows said first embodiment of screw-type cap 10 threaded onto bottle neck 30 to a point just before flanges 15 engage stop ring 32. Because of the conical shape of stop ring 32, flanges 15 on tamperproof strip 14, and thus tamperproof strip 14 itself, are forced radially outward as cap 10 is threaded onto bottle neck 30. As this occurs, tamperproof strip 14 is stretched in an accordionlike manner by expansion means 20 and recesses 22 and 24, as is shown in FIG. 2. Because cap body 12 of screw-cap 10 presses down on permanent connection 18 and webs 16, the latter are placed under pressure and are thus unable to fracture. If the screw-cap is threaded further on bottle neck 30, flanges 15 on tamperproof strip 14 engage stop ring 32, and tamperproof strip 14 is again contracted. This results in the position of the cap as shown in FIG. 1.

Figure 3:
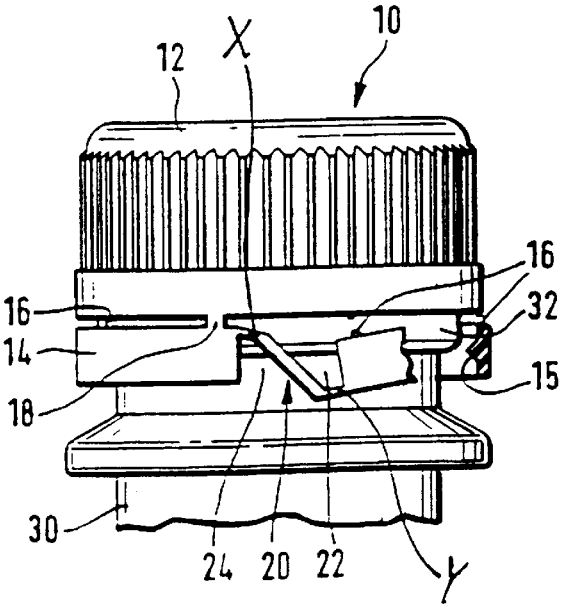
FIG. 3 is a side view of said first embodiment when unthreaded with a partial sectional view through the tamperproof strip.

FIG. 3 shows said first embodiment of screw-cap 10 as it is unthreaded from bottle neck 30. Flanges 15 which initially abut stop ring 32 secure tamperproof strip 14, and with it cap body 12 by way of permanent connection 18 and webs 16 to bottle neck 30. By further rotating cap body 12, the tension in webs 16 finally becomes so great that the latter fracture. However, tamperproof strip 14 remains fixed via permanent connection 18 to cap body 12 and tamperproof strip 14 is expanded by expansion means 20 with recesses 22 and 24, thereby causing flanges 15 to slip past stop ring 32. Screw-cap 10 may then be completely removed from bottle neck 30 while tamperproof strip 14 remains attached to cap body 12 and without the ends thereof protruding. Due to the fractured webs, however, it is immediately apparent that the cap in question was previously opened.

Expansion means 20 with recesses 22 and 24 allows tamperproof strip 14 to be stretched to a point where bottle neck 30 is once again easily resealable.

Figure 4:
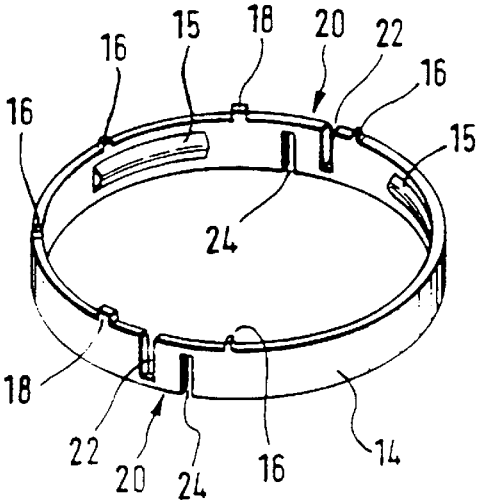
FIG. 4 is a perspective view of the tamperproof strip of said first embodiment.

FIG. 4 is a perspective view of tamperproof strip 14 of said first embodiment. Tamperproof strip 14 has two expansion means 20 located opposite one another, each of which includes two recesses 22 and 24, respectively. Said recesses 22 and 24 are formed as slots, each of which are open-ended at opposite edges, respectively, of the tamperproof strip. Disposed on the inside of tamperproof strip 14 are flanges 15 which are arranged as segments in the present embodiment.

They may however extend continuously along the inside of the strip. Finally, two permanent connections 18 and several webs 16 are formed along the top edge of tamperproof strip 14.

In said first embodiment according to FIGS. 1–4, vertical lines of weakening are omitted. This makes further cutting unnecessary in the case of a cap with a thick tamperproof strip and in which flanges 15 are heavily back tapered. With expansion means 20, extreme expandability of tamperproof strip 14 is assured in the final mold during manufacturing and when threaded onto the neck of the bottle. This process utilizes the natural resiliency of the plastic materials used. Through selection of wall thickness within expansion means 20 and cross-section of webs 16, the expansion of tamperproof strip 14 must be properly gauged to avoid fracturing during the manufacturing process, and so that the natural resiliency of the plastic material used remains optimally intact.

The aforementioned is achieved essentially through the selection of wall thickness in both horizontal links X and Y (FIG. 3) of the expansion means. If more than the fracturing of webs 16 is required, extreme expansion of tamperproof strip 14 and suitable differences in wall thickness between links X and Y may cause link X to break as well. In such case, link Y would be thicker than link X.

Figure 5:
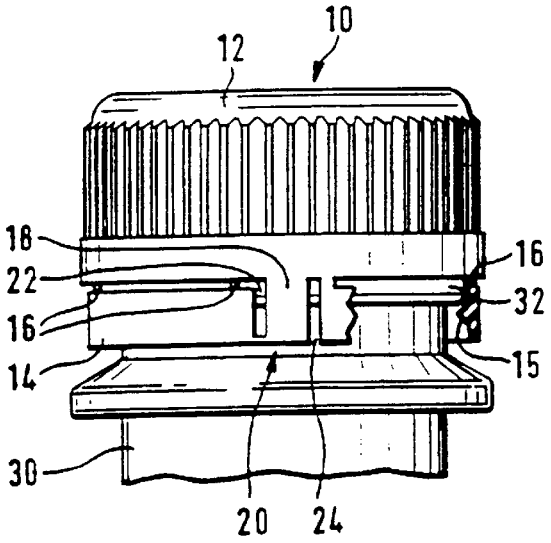
FIG. 5 is a side view of a second embodiment of the screw-type cap according to the present invention when threaded, with a partial sectional view through the tamperproof strip.

FIG. 5 shows a second embodiment of a screw-type cap 10 according to the present invention. Screw-cap 10 is comprised essentially of a cap body 12 and a tamperproof strip 14, and is shown here threaded onto bottle neck 30. Tamperproof strip 14 is attached to cap body 12 by permanent connection 18 and webs 16. Arranged on the inside of tamperproof strip 14 are flanges 15 which in the threaded state, engage stop ring 32 from behind. Tamperproof strip 14 further includes an expansion means 20, also with two recesses 22 and 24. Recesses 22 and 24 are formed as slots, each being open-ended at opposite edges, respectively, of the tamperproof strip. In contrast to said first embodiment, as shown in FIGS. 1–4, the permanent connection 18 of said second embodiment is located between recesses 22 and 24.

Figure 6:
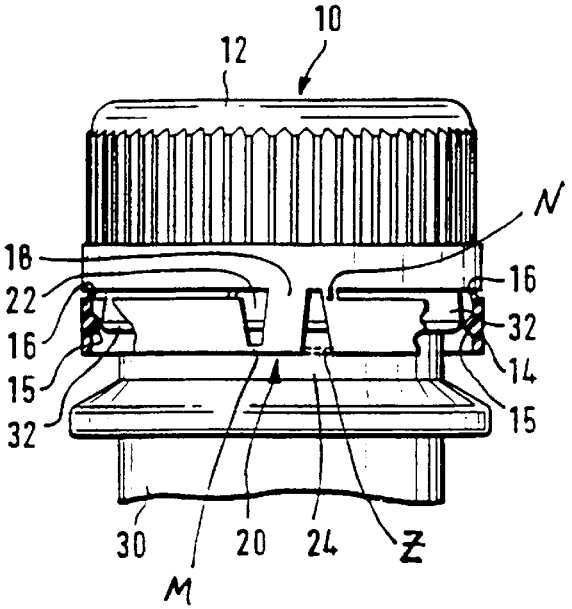
FIG. 6 is a side view of said second embodiment when threaded, with two partial views through the tamperproof strip.
Figure 7:
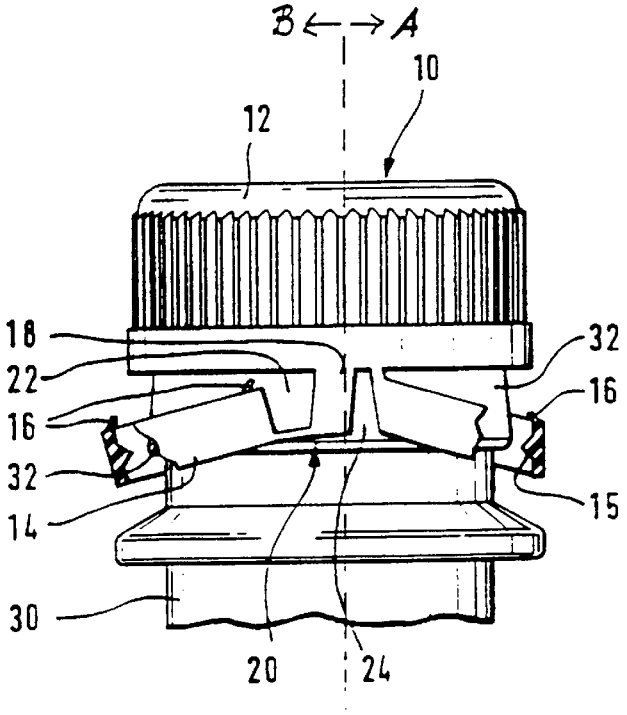
FIG. 7 is a side view of said second embodiment when unthreaded with two partial sectional views through the tamperproof strip.

FIG. 6 is a side view of said second embodiment with a partial sectional view through tamperproof strip 14 when the cap is threaded, and FIG. 7 when the cap is unthreaded. The operation of expansion means 20 was described in detail above with reference to FIGS. 1–4, hence no further description thereof is provided here.

In this embodiment as well vertical lines of weakening are omitted. Here, tamperproof strip 14 is divided into two functional halves.

The first half A serves essentially to allow expansion of tamperproof strip 14 while being threaded onto the bottle during the manufacturing process. The expansion step is ensured by undercutting flanges 15, webs 16 and link N (FIG. 6). Half A is capable of extreme expansion, freely and independently of half B. Alternatively, it may be useful to provide an additional weak link Z (represented by dashed lines in FIG. 6).

The second half B ensures essentially that the tamperproof function is reliable. During the manufacturing process, expansion is effected by expansion means 20 in conjunction with horizontal link M (FIG. 6). With the difference in wall thickness between links M and Z, substantially the same effect is achieved as with the differences in links X and Y in said first embodiment.

The purpose of dividing the tamperproof strip into two functional halves A and B is seen in that the second half B is required to expand less than the first half A. This serves to further enhance the reliability of the tamperproof function and to facilitate resealing of the bottle by the consumer.

What is claimed is:

1. A screw cap made of plastic for bottles with a stop ring on the neck, comprising a cap body with an internal thread and a tamperproof strip with flanges arranged on the interior surface thereof, the tamperproof strip being non-breakable and connected to the cap body by webs in which, as the screw-cap is unthreaded from the bottle, tension is increased causing the fracture, and which has an expansion means with at least one permanent connection provided in the area of the expansion means between the tamperproof strip and the cap body, wherein the expansion means, as the cap body is threaded onto the bottle, uniformly expands the tamperproof strip along its entire width in a radial direction in such a way that the flanges slip past the stop ring, and said expansion means has at least two recesses which extend substantially transversely along the inside of the tamperproof strip and which are open-ended at opposite edges, respectively, of said tamperproof strip.

2. A screw bottle cap according to claim 1, wherein the tamperproof strip is provided with two expansion means arranged on diametrically opposite sides of said strip.

3. A screw bottle cap according to claim 2, wherein said expansion means has two recesses arranged on one side of the permanent connection.

4. A screw bottle cap according to claim 2, wherein said expansion means has two recesses arranged on opposite sides of the permanent connection.

5. A screw bottle cap according to claim 1, wherein said tamperproof strip is formed without vertical lines of weakening.

* * * * *